United States Patent [19]

Trisolini

[11] 4,344,201

[45] Aug. 17, 1982

[54] CLEANING APPARATUS

[76] Inventor: George S. Trisolini, Via Donatello 5, Palagino, Italy

[21] Appl. No.: 212,634

[22] Filed: Dec. 3, 1980

[51] Int. Cl.[3] ..... B08B 11/02

[52] U.S. Cl. ..... 15/3; 15/143 R; 15/229 B; 15/260

[58] Field of Search ..... 15/3, 119 R, 120 R, 15/120 A, 143, 229 R, 229 B, 260, 263

[56] References Cited

U.S. PATENT DOCUMENTS 217,675 7/1879 Boswell ..... 15/263
684,115 10/1901 Shaw ..... 15/120 A
1,426,440 8/1922 Zieschang ..... 15/119 R

FOREIGN PATENT DOCUMENTS 800753 12/1968 Canada ..... 15/120 A

*Primary Examiner*—Robert L. Bleutge
*Attorney, Agent, or Firm*—Samuelson & Jacob

[57] ABSTRACT

A cleaning apparatus includes a mop with a rotatable wiper, a pail having a reservoir for cleaning liquid, and a motor-driven wringer mounted upon the pail for receiving and rotating the wiper of the mop at relatively high speed to extract cleaning liquid together with entrained dirt and other matter from the wiper and return the extracted liquid to the reservoir.

11 Claims, 6 Drawing Figures

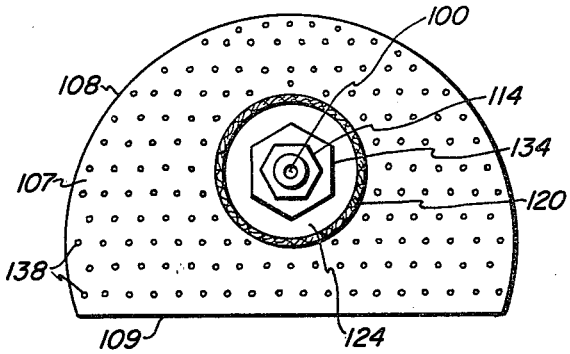
FIG. 5
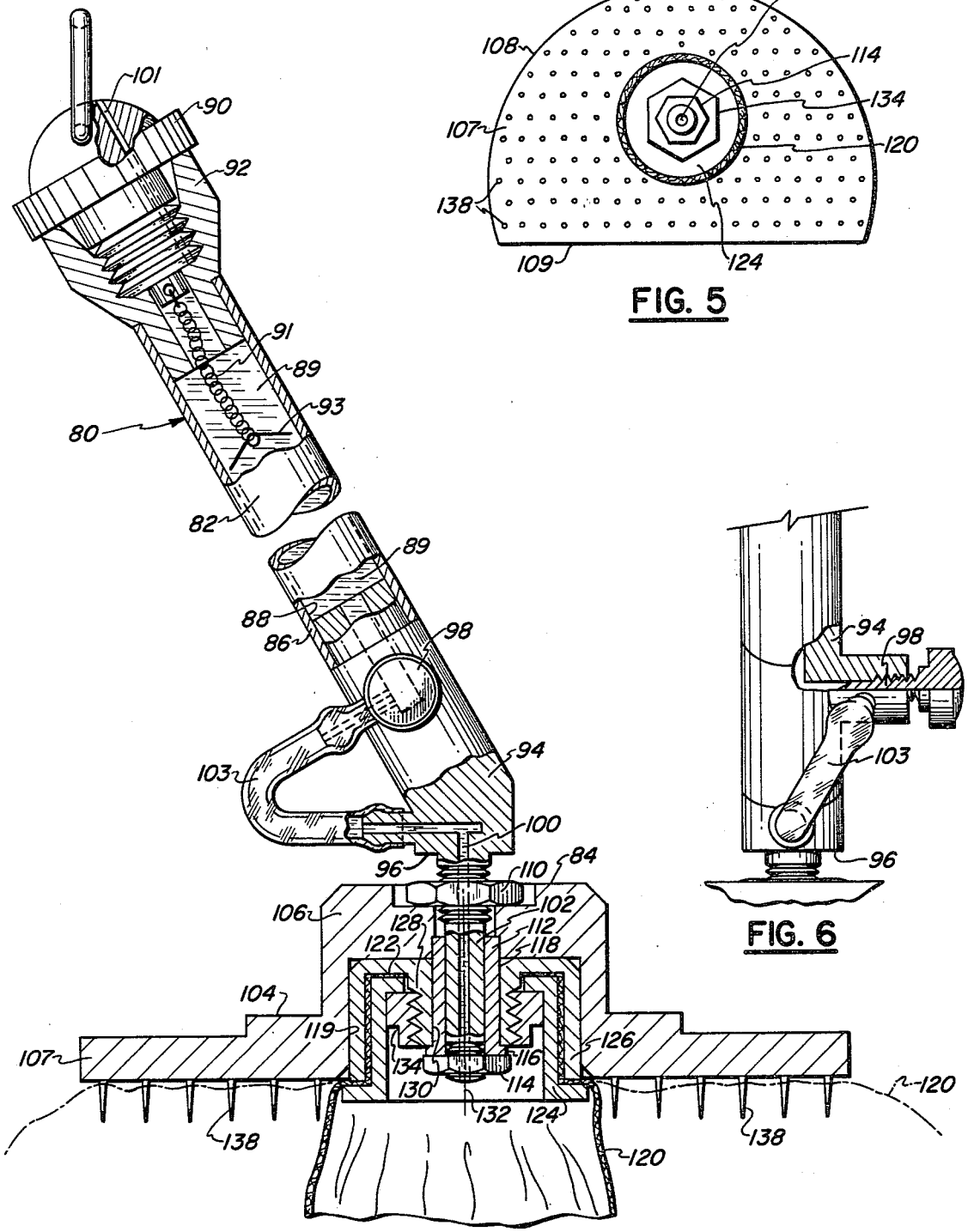
FIG. 6
FIG. 4

CLEANING APPARATUS

The present invention relates generally to cleaning apparatus and pertains, more specifically, to a cleaning apparatus employing a mop and a mop wringer.

One of the most common types of cleaning apparatus is the ubiquitous mop and pail found in use throughout the world for cleaning a variety of surfaces in industrial, commercial and residential buildings. Almost everyone is familiar with the routine procedure by which a mop is immersed in a liquid cleaning medium, such as water, contained in a pail, and then is wiped over the surface to be cleaned so as to spread and then pick up the cleaning medium together with dirt and other matter to be removed from the cleaned surface. The mop is wrung to extract the cleaning medium, together with the matter entrained in the cleaning medium, and the wiping is repeated. The ease and effectiveness of the procedure rely heavily upon the ability to remove the dirt and other matter from the mop during wringing so as to assure that such matter will not be returned by the mop to the surface being cleaned. Such a return of dirt and other matter usually appears in the form of streaks and other unwanted blemishes on the surface being cleaned.

It is an object of the present invention to provide a mop and a wringer for the mop which together provide easier and more effective cleaning by virtue of the ease and effectiveness with which the cleaning medium and entrained dirt and other unwanted matter are extracted from the mop during cleaning operations.

Another object of the invention is to provide an improved wringer for mops, which wringer is motor-driven to effect maximum extraction of unwanted matter from a mop with minimal effort on the part of the user and without requiring that the user touch the wet wiper or come into contact in any way with the soiled wiper or cleaning medium, thereby providing a more sanitary apparatus.

Still another object of the invention is to provide an improved mop especially suited for use with the aforesaid wringer.

Yet another object of the invention is to provide cleaning apparatus which contains a reservoir of liquid cleaning medium easily accessible to a mop and includes an improved motor-driven wringer for extracting the cleaning medium from the mop during cleaning operations and returning the cleaning medium to the reservoir.

A further object of the invention is to provide a motor-driven wringer of the type described and which is operated automatically in response to placement of the mop into the wringer, thereby enhancing ease of operation and maintaining more sanitary conditions for the operator.

A still further object of the invention is to provide a cleaning apparatus of the type described, and especially a motor-driven wringer for use in connection with a mop, which is relatively simple in design and construction and is economical to manufacture so as to find widespread use in industrial, commercial and residential cleaning.

Yet a further object of the invention is to provide cleaning apparatus of the type described and which is exceptionally easy to use and which enables dramatically improved results without a wide departure from conventional cleaning techniques.

The above objects, as well as still further objects and advantages, are attained by the present invention which may be described briefly as a cleaning apparatus comprising a mop having a handle, a wiper mounted on the handle for rotation relative thereto, and a mop wringer for extracting from the wiper of the mop matter carried by the wiper, the mop wringer having a housing, an opening in the housing for passing at least a portion of the wiper of the mop therethrough, a basket within the housing and juxtaposed with the opening for receiving said portion of the wiper of the mop, the basket having an axially-extending perforated wall, means mounting the basket for rotation in the housing about an axis extending in the same general direction as the axially-extending perforated wall of the basket, and a motor coupled with the basket for rotating the basket and, consequently, the wiper of the mop when the portion of the wiper is in the basket, about the axis such that the wiper is forced against the perforated wall of the basket and matter in the wiper is extracted therefrom through the perforated wall of the basket.

The invention will be understood more fully, while still further objects and advantages will become apparent, in the following detailed description of an embodiment of the invention illustrated in the accompanying drawing, in which:

FIG. 4 is an enlarged, elevational view of the mop, mostly in cross-section;

FIG. 5 is a reduced, bottom plan view of a portion of the mop of FIG. 4; and FIG. 6 is a fragmentary end elevational view, partially in cross-section, showing a portion of the mop of FIG. 4.

Figure 1:
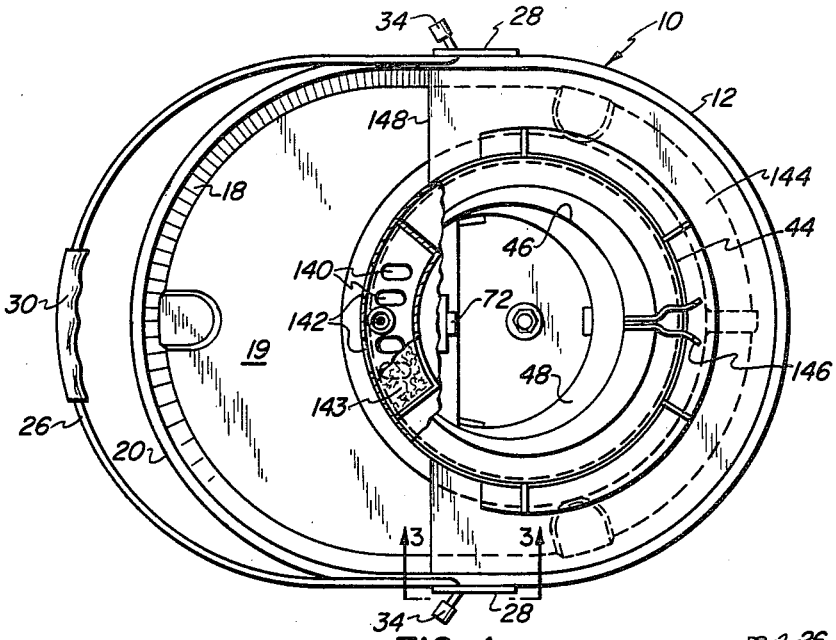
FIG. 1 is a top plan view of a wringer and pail unit constructed in accordance with the invention.
Figure 3:
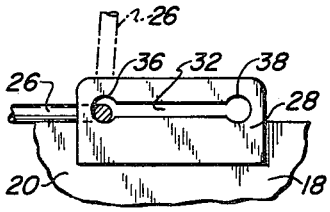
FIG. 3 is an enlarged fragmentary view of a portion of the unit, taken along line 3—3 of FIG. 1.
Figure 2:
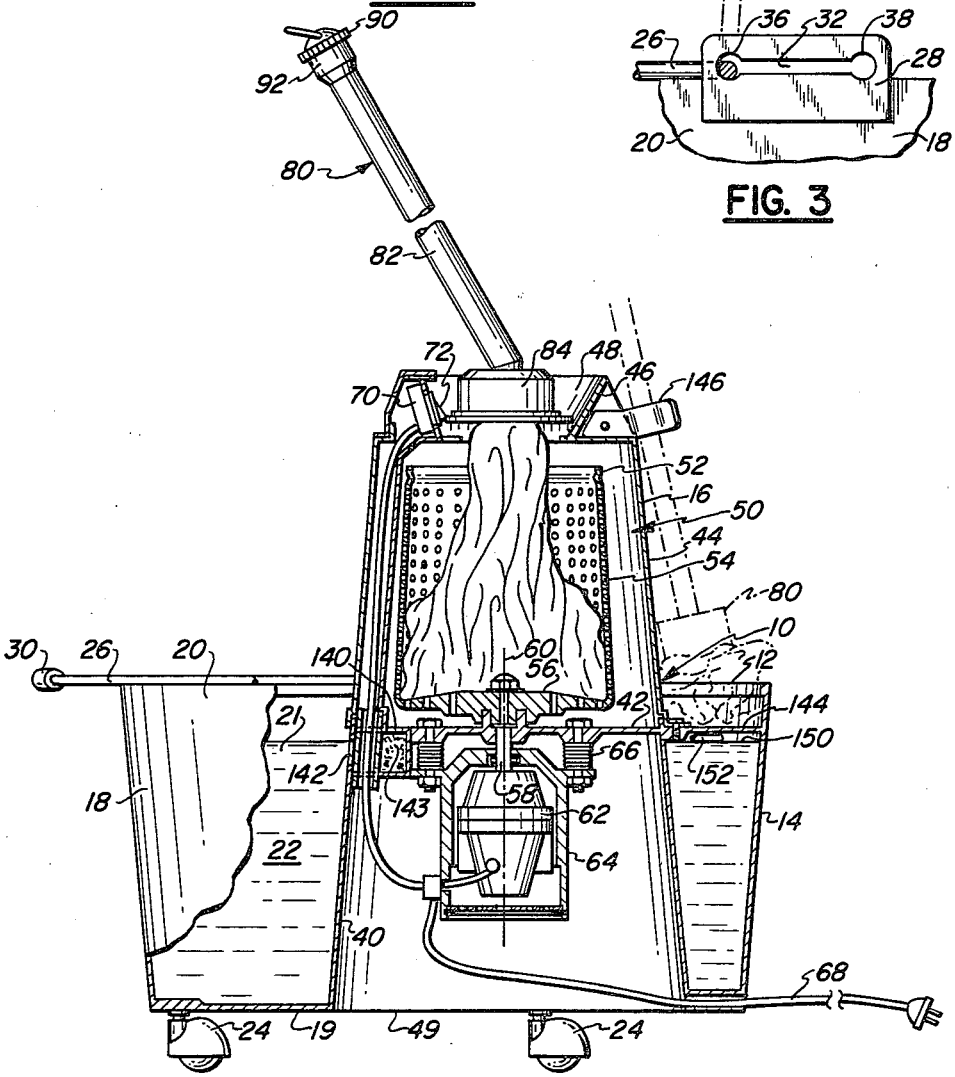
FIG. 2 is a side elevational view, partially in cross-section, of the wringer and pail unit with a mop placed therein.

Referring now to the drawing, and especially to FIGS. 1 through 3 thereof, cleaning apparatus constructed in accordance with the invention is shown generally at 10 and is seen to have a housing 12 including a lower member 14 and an upper member 16. Lower member 14 includes a side wall 18 and bottom 19 which together establish a pail 20 with access through an open top to a reservoir 21 for containing a liquid cleaning medium 22, ordinarily in the form of water.

Pail 20 is supported upon casters 24 for ease of maneuvering apparatus 10 along a floor during use. A bail 26 is attached to the pail 20 at ears 28 and may be pivoted between a rest position, as seen in full lines in FIGS. 1 through 3, and a raised position, as seen in phantom in FIG. 3. A handle 30 is carried by the bail 26 and enables the bail 26 to be grasped for manipulation of the bail 26 and maneuvering of the pail 20. As seen in FIG. 3, ears 28 include slots 32 through which the hooked ends 34 of bail 26 are passed. The slots 32 have enlarged openings at 36 and 38 so as to enable the bail 26 to be located at either one of two alternate locations relative to the pail 20. The two locations represent the difference in balance points depending upon whether the reservoir 21 of pail 20 is full or empty, so that the bail 26 may be located appropriately in either case.

Side wall 18 has an inner wall portion 40 which extends upwardly and carries a mounting plate 42 and a side cover wall 44 which extends upwardly over the mounting plate 42 and is a part of upper member 16. A top cover wall 46 is located at the top of the side cover 44 and has an opening 48 therein. It is noted that upper member 16 has a frusto-conical overall configuration and inner wall portion 40 has a complementary frusto-conical inside configuration open at its base 49. Thus, for compact packing and shipping, upper member 16 can be disassembled from lower member 14 and nested within inner wall portion 40.

Apparatus 10 has a wringer 50 housed in the upper member 16 of housing 12. Wringer 50 includes a basket 52 having a perforated side wall 54 and bottom wall 56 coupled to a central shaft 58 for rotation about a central vertical axis 60. Central shaft 58 is rotated by a motor 62 seated within a casing 64 which is suspended from mounting plate 42 by means of a resilient suspension system 66. Motor 62 is an electric motor which receives power from a line cord 68 through an electric switch 70 juxtaposed with the opening 48 in the top cover 46. Alternately, motor 62 can be powered by a battery (not shown) so that apparatus 10 can be self-contained. The actuator 72 of switch 70 extends into opening 48 for purposes which will be explained below.

Apparatus 10 also has a mop 80. Turning now to FIGS. 4 through 6, as well as to FIG. 2, mop 80 has an elongate mop handle 82 and a mop head 84. Handle 82 preferably is in the form of a hollow tube 86 which provides a chamber 88 for containing a liquid cleaning agent 89, such as soap or detergent. A filler cap 90 is threaded into upper end member 92 of the mop handle 82 and is selectively removed for filling the chamber 88 with cleaning agent. A beaded chain 91 is affixed to filler cap 90 and carries a spring retainer 93 which secures filler cap 90 against loss when the filler cap is removed from upper end 92 for filling. A fitting 94 at the lower end 96 of the mop handle 82 includes a needle valve 98 for metering the flow of cleaning agent through a passage 100 which passes through an axle 102 which depends from fitting 94 and is integral therewith. A vent 101 is placed in filler cap 90 to enable air to flow into chamber 88. Vent 101 is closed when cap 90 is seated within upper end member 92, as shown in FIG. 4, and is opened by unseating the cap slightly. A flexible, transparent tube 103 carries the liquid cleaning agent 89 from the needle valve 98 to the lower end 96 of the mop handle 82 and provides means for verifying the flow of cleaning agent and for visually determining when the supply of cleaning agent is exhausted.

Mop head 84 has a base 104 secured to axle 102. Base 104 includes a hub 106 and a flange 107 having a semicircular plan configuration including an arcuate edge 108 and a chordal edge 109, as seen in FIG. 5. Hub 106 is clamped between an upper nut 110 and a sleeve 112 which is urged against hub 106 by a lower nut 114. Sleeve 112 includes a lower flange 116 and an outer cylindrical bearing surface 118 extending into a recess 119 in hub 106. A wiper 120, shown in the form of a generally annular cloth, such as terry cloth, is secured at the inner periphery 122 thereof between complementary cup-shaped inner and outer retainers 124 and 126, respectively. Outer retainer 126 includes a central depending extension 128 having an inner bearing surface 130 complementary to cylindrical bearing surface 118 on sleeve 112 so as to journal outer retainer 126 for rotation about an axis 132 extending along axle 102. A retaining nut 134 is threaded onto extension 128 to secure together inner and outer retainers 124 and 126 and to clamp wiper 120 therebetween. Thus, wiper 120 is free to rotate, along with retainers 124 and 126, about axis 132 upon bearing surface 118 between flange 116 and hub 106. A plurality of short spikes 138 project downwardly from the flange 107 of base 104, for purposes which will be described hereinafter.

In using apparatus 10, cleaning medium 22 is placed in reservoir 21 within pail 20 and a cleaning agent 89 is placed in chamber 88 of mop handle 82. Wiper 120 of mop 80 is then inserted through the open top of the pail 20 and dipped into the cleaning medium 22 in reservoir 21 and, once saturated with cleaning medium, wiper 120 is wiped along the surface to be cleaned. In placing wiper 120 against the surface to be cleaned, the wiper will spread out radially beneath the flange 107 of mop head 84 and will be engaged by flange 107 and positively gripped by spikes 138, as seen in phantom in FIG. 4, so as to be retained in the spread-out configuration and to preclude rotation of the wiper relative to mop head 84 for increased wiping effectiveness. Cleaning agent 89 is metered and dispensed to wiper 120 through needle valve 98 and passage 100.

When it is desired to wring wiper 120, mop head 84 is inserted into opening 48 in the top cover wall 46 of wringer 50 such that the wiper 120 falls downwardly away from flange 107, out of engagement with spikes 138, and rests in the basket 52. When the mop head 84 is fully inserted, the flange 107 is fitted into the complementary opening 48 so as essentially to seal the opening 48 and the chordal edge 109 of flange 107 of base 104 will engage the actuator 72 of switch 70, as seen in FIG. 2, thereby energizing motor 62 and causing the basket 52 to spin at high speed, i.e., about 800 to 900 rpm. Since the wiper 120 is mounted for rotation and is free to spin relative to axle 102 of the mop head 84, the wiper 120 also will spin at high speed and will be thrown against the perforated side wall 54 of basket 52. The cleaning medium within the wiper 120 thus will be extracted from the wiper by centrifugal action and will pass through the perforated side wall 54 of basket 52, carrying with it entrained dirt and other unwanted matter. The extracted cleaning medium will be confined within the sealed chamber provided by upper member 16 and the flange 107 so as not to be splashed outside of the apparatus 10 and will be drained through drain holes 140 and 142 to be returned to the reservoir 21, by virtue of the location of wringer 50 above the reservoir 21. Preferably, a filter 143 is placed between the drain holes 140 and 142 to collect and remove dirt and other unwanted matter from the cleaning medium which is returned to the reservoir. When the wiper is wrung out, the mop 80 is lifted to remove mop head 84 from opening 48, thereby disengaging actuator 72 and deactivating motor 62. Thus, wringing of the wiper is accomplished automatically, effectively and without requiring the operator to touch the wiper or come into contact with the cleaning medium in any way.

If it is desired to rest the mop 80 between wipings, the wiper 120 may be rested upon a shelf 144 and the mop 80 held in place by inserting the mop handle 82 into a spring clip 146 affixed to the upper member 16, as shown in phantom in FIG. 2. Any cleaning medium which may run out of wiper 120 will flow along shelf 144 and run off the edge 148 of the shelf 144 to return to the reservoir 21. Shelf 144 is located above the level of the cleaning medium 22 in reservoir 21, the cleaning medium being limited to an uppermost level 150 by virtue of the presence of overflow openings 152 in the side wall 18.

The semi-circular configuration of flange 107 has been found to have advantages in easier cleaning in corners and in other close quarters, as well as being easily fitted into opening 48. Wiper 120 may be removed merely by removing retaining nut 134 and inner retainer 124 to release the portion of wiper 120 which is clamped between inner and outer retainers 124 and 126. Replacement of wiper 120 is accomplished merely by reversing that procedure. Wiper 120 can be provided in the form of practically any conventional mop material, including string materials as well as various cloths, all of which will be more effective in use in connection with apparatus 10 than in conventional mops and mop wringers.

The high-speed spin wringer of apparatus 10 assures that dirt and other unwanted materials will be extracted from the wiper so as to enable streak-free cleaning with minimal effort. The totally enclosed wringer precludes unwanted splashing and uncontrolled distribution of the extracted cleaning medium. The operation of the wringer is automatic and requires no direct contact between the user and the wiper or the matter entrained in the wiper, thereby enabling a more sanitary operation.

Thus, apparatus 10 provides easier and more effective cleaning with minimal effort on the part of the user of the apparatus.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. Cleaning apparatus comprising:

a mop having a handle; and a wiper mounted on the handle for rotation relative thereto; and a mop wringer for extracting from the wiper of the mop matter carried by the wiper, the mop wringer having a housing;

an opening in the housing for passing at least a portion of the wiper of the mop therethrough;

a basket within the housing and juxtaposed with the opening for receiving said portion of the wiper of the mop, the basket having an axially-extending perforated wall;

means mounting the basket for rotation in the housing about an axis extending in the same general direction as the axially-extending perforated wall of the basket; and a motor coupled with the basket for rotating the basket and, consequently, the wiper of the mop when said portion of the wiper is in the basket, about said axis such that the wiper is forced against the perforated wall of the basket and matter in the wiper is extracted therefrom through the perforated wall of the basket.

2. The invention of claim 1 including a reservoir for containing a liquid cleaning medium and access means enabling access to the liquid cleaning medium by the wiper of the mop.

3. The invention of claim 1 or 2 wherein the housing radially surrounds the perforated wall of the basket to collect the extracted matter.

4. The invention of claim 3 including a drain for passing the collected extracted matter to the reservoir.

5. The invention of claim 4 wherein the basket is located above the level of the liquid cleaning medium in the reservoir so that the collected extracted matter passes through the drain by gravity.

6. The invention of claim 1 or 2 including:

an actuator located in the housing for actuation in response to the placement of the wiper of the mop within the basket; and means for energizing the motor in response to actuation of the actuator such that the basket is rotated by the motor when the wiper is in the basket.

7. The invention of claim 6 wherein the motor is an electric motor and the means for energizing the motor includes an electric switch operated by the actuator.

8. The invention of claim 1 wherein the mop includes a head affixed to the handle, the head including a base and means mounting the wiper for rotation relative to the base, the base including a flange for engaging the wiper when the wiper is wiped across a surface to be cleaned.

9. The invention of claim 8 wherein the flange has a semi-circular plan configuration including an arcuate edge portion and a chordal edge portion.

10. The invention of claim 8 or 9 wherein the flange includes means for positively gripping the wiper when the wiper is engaged by the flange for wiping so as to preclude rotation of the wiper relative to the flange during wiping, and for releasing the engagement of the wiper and flange for enabling rotation of the wiper relative to the flange when the wiper is received in the basket of the mop wringer.

11. The invention of claim 8 or 9 wherein the handle of the mop includes a chamber for containing a cleaning agent, and the head of the mop includes dispensing means for dispensing cleaning agent from the chamber to the wiper of the mop.

* * * * *